US008931470B1

(12) United States Patent
Khoshnood et al.

(10) Patent No.: US 8,931,470 B1
(45) Date of Patent: Jan. 13, 2015

(54) ARCHERY BOW VIBRATION DAMPENING AND BALANCING DEVICE

(71) Applicants: Bahram Khoshnood, Alpharetta, GA (US); David L. Potts, New Philadelphia, OH (US)

(72) Inventors: Bahram Khoshnood, Alpharetta, GA (US); David L. Potts, New Philadelphia, OH (US)

( * ) Notice: Subject to any disclaimer, the term of this patent is extended or adjusted under 35 U.S.C. 154(b) by 77 days.

(21) Appl. No.: 13/735,155

(22) Filed: Jan. 7, 2013

(51) Int. Cl.
*F41B 5/20* (2006.01)
*F41B 5/14* (2006.01)

(52) U.S. Cl.
CPC ..... *F41B 5/1426* (2013.01)
USPC ..... 124/89

(58) Field of Classification Search
USPC ..... 124/86, 88, 89
See application file for complete search history.

(56) References Cited

U.S. PATENT DOCUMENTS

| | | | | |
|---|---|---|---|---|
| 6,298,842 | B1 * | 10/2001 | Sims | 124/89 |
| 7,703,449 | B2 * | 4/2010 | Wright | 124/89 |
| 2004/0107952 | A1 * | 6/2004 | Kronfeld | 124/89 |

* cited by examiner

*Primary Examiner* — John Ricci
(74) *Attorney, Agent, or Firm* — Rodgers & Rodgers

(57) ABSTRACT

A holder for an archery bow vibration dampening and balancing means is secured between two split limbs of an archery bow flexible arm and includes an attachment holding means for receiving a vibration dampening and/or balancing device.

12 Claims, 7 Drawing Sheets

ARCHERY BOW VIBRATION DAMPENING AND BALANCING DEVICE

BACKGROUND OF THE INVENTION

Over time, archery bows have advanced in sophistication and modern archery bows, when manipulated, are subjected to a great deal of inherent vibration from the tension in the bow which is transferred from the bow riser to the archer's hand. When this occurs, the accuracy of the archery shot is compromised. Also, vibration causes fatigue to occur during lengthy practice sessions.

A large number of devices have been developed and utilized to overcome the problem of archery bow vibration. Due to varying characteristics in the archery bow in combination with the level of expertise of the archer, different vibration dampening and balancing devices are employed as the varying needs dictate. There is not a single device that accommodates all situations and, therefore, there is a need to select the desired vibration dampening or balancing device which can be quickly and conveniently interchanged with another device without the need to change the entire mechanism.

BRIEF SUMMARY OF THE INVENTION

By this invention, a holder for an archery bow vibration dampening and balancing means device is provided and includes a generally circular attachment housing to receive a vibration dampening or balancing device with an attachment bar interconnected to the attachment housing. A flexible base is provided with a flanged cavity for receiving the attachment bar in an interconnected relation with the flexible base adapted for attachment between the split limbs of an archery bow flexible limb.

An alternative form of the holder includes a generally circular attachment housing for receiving a vibration dampening or balancing device whereby the holder is interconnected between two split limbs of an archery bow by means of a pair of apertured attachment rings secured to the attachment housing with the split limbs sandwiched between the two flexible rubber apertured attachment rings.

DETAILED DESCRIPTION OF THE INVENTION

Figure 4:
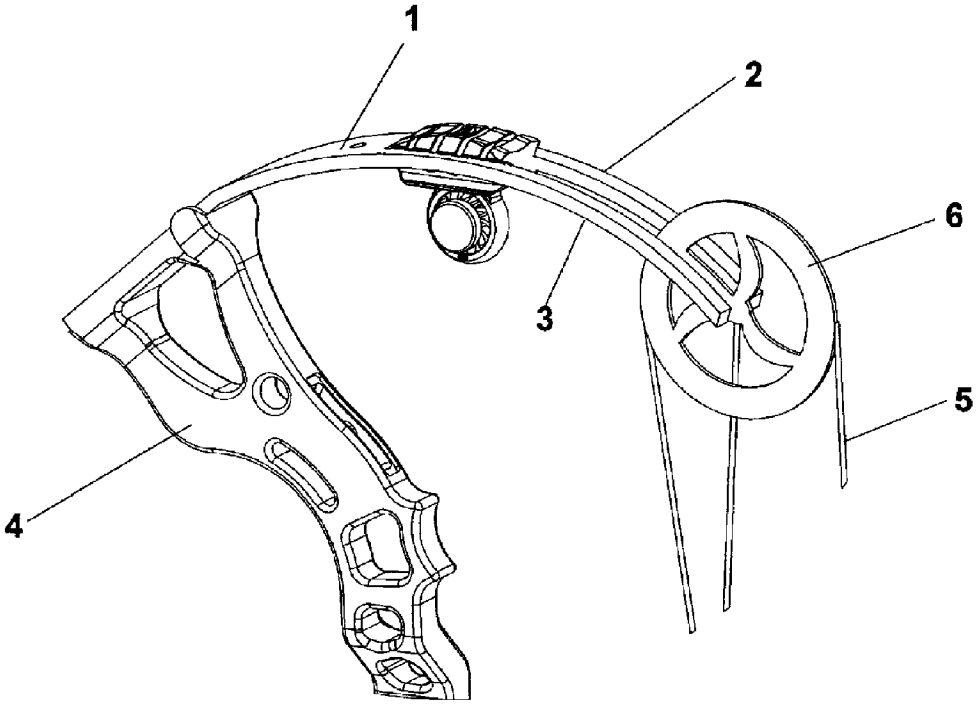
FIG. 4 is a fragmentary view of an archery bow with the holder attached to one flexible limb of the bow.
Figure 7:
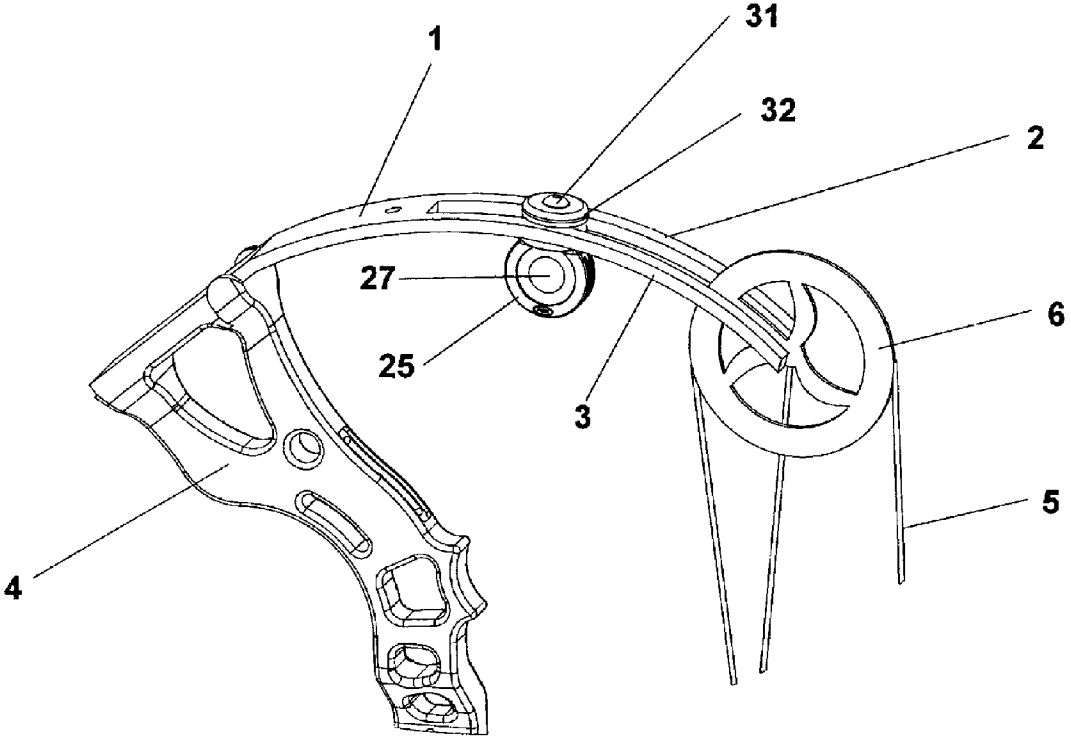
FIG. 7 is a fragmentary view of an archery bow with the holder attached to one flexible limb of the bow.

In the drawings, and with particular reference to FIGS. 4 and 7, a portion of a conventional archery bow is shown in which flexible arm 1 includes outwardly extending split limbs 2 and 3. Riser 4 is interconnected to flexible limb 1 opposite split limbs 2 and 3. As is well known, bow string 5 is strung around cam 6. Of course, an identical flexible arm and associated structure is disposed on the opposite side of riser 4 to complete the basic archery bow apparatus.

According to this invention, and as shown in FIGS. 1-4, a vibration dampening and balancing device holder for an archery bow is provided and includes flexible base 7 which includes multiple ribs 8 disposed on the top thereof. Base 7 includes indented sides 9 and 10 and bottom 11. Indented sides 9 and 10 are provided with spaced protrusions 12 which self-adjust to accommodate spacing variations in split limbs 2 and 3.

Figure 3:
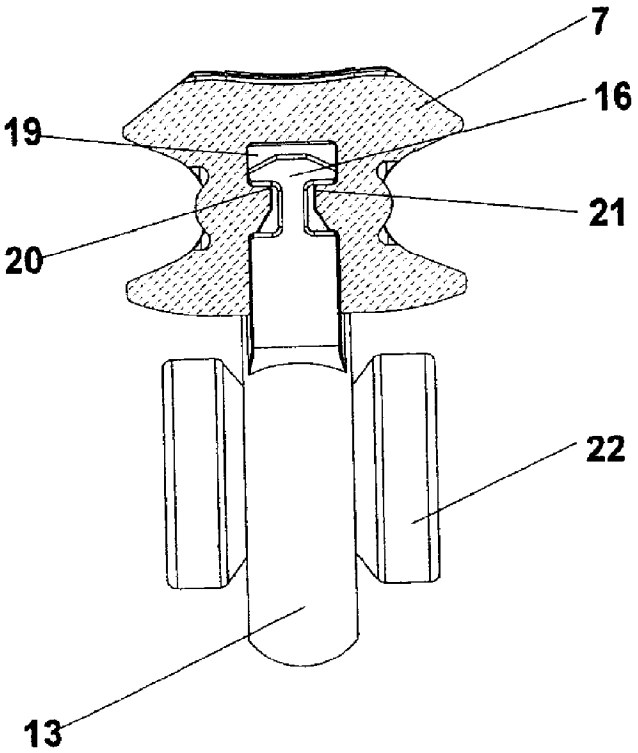
FIG. 3 is a cross-sectional view of the holder shown in FIG. 1.

To complete the holder for the vibration dampening and balancing means, according to this invention, attachment holder 13 includes coupling 14 attached thereto. Attachment holder 13 is manufactured of aluminum or other suitable material. Neck 15 extends upwardly from coupling 14 remote from attachment holder 13 with attachment bar 16 integrally joined to neck 15 remote from coupling 14. Shoulders 17 and 18 extend outwardly from the sides of attachment bar 16. With reference to FIG. 3, cavity 19 is formed in the interior of base 7 and flanges 20 and 21 are formed on the interior of base 7 and extend into cavity 19.

For the purpose of providing an archery bow vibration dampening or balancing capability, device 22 is provided and includes outer ring 23 formed around the periphery thereof. Groove 24 is formed on the interior of attachment holder 13 and is adapted to receive outer ring 23 to secure device 22 in its operating position, as shown in FIG. 1.

Alternatively, attachment holder 13 and flexible base 7 are integrally joined together whereby the entire holder is made of flexible material such as rubber.

Figure 1:
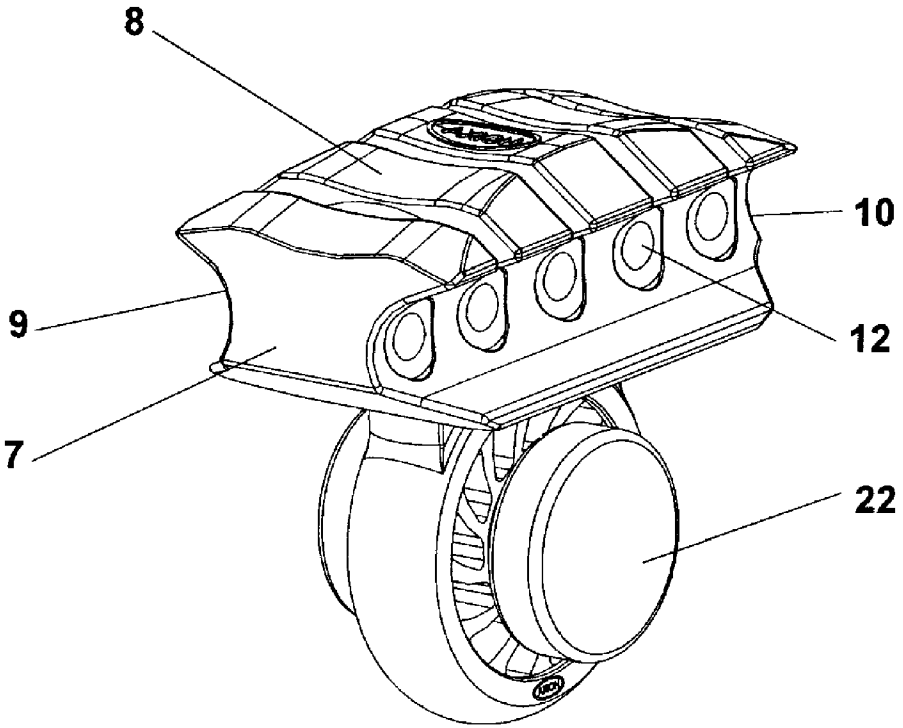
FIG. 1 is a perspective view of one version of the attachment device according to this invention.
Figure 2:
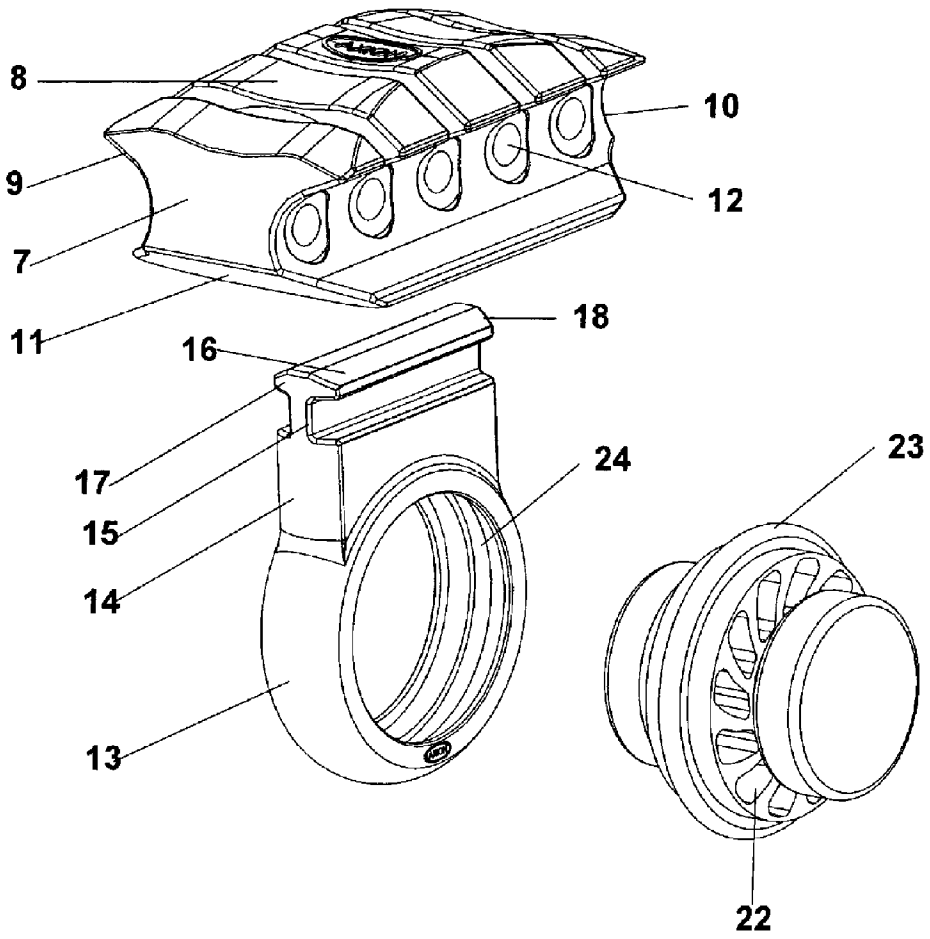
FIG. 2 is a perspective exploded view of the holder shown in FIG. 1.

In order to install the vibration dampening and balancing device, shown in FIGS. 1-4, on the archery bow, device 22 is inserted into attachment holder 13 and attachment bar 16 is then inserted into cavity 19 such that shoulders 17 and 18 overlap flanges 20 and 21, respectively. Then flexible base 7, with device 22 attached thereto, as shown in FIG. 1, and because of its flexibility, is squeezed inwardly and manipulated to a position between split limbs 2 and 3 of the archery bow, as shown in FIG. 4, so that split limbs 2 and 3 are disposed within indented sides 9 and 10, respectively, and in face contacting relation with protrusions 12.

Figure 5:
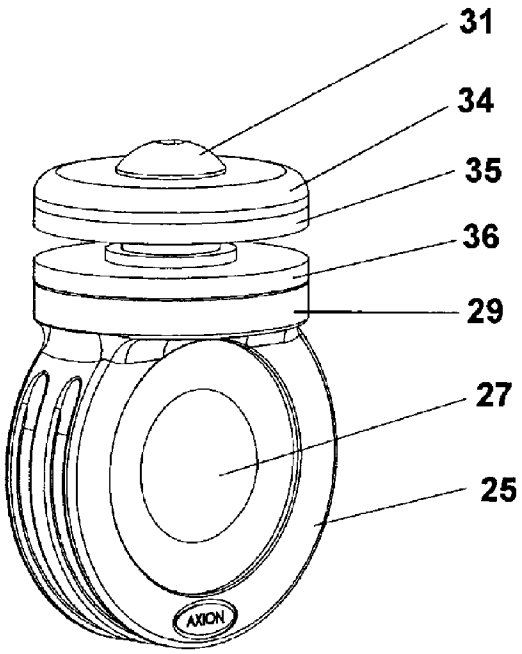
FIG. 5 is a perspective view of a modification of the invention.
Figure 6:
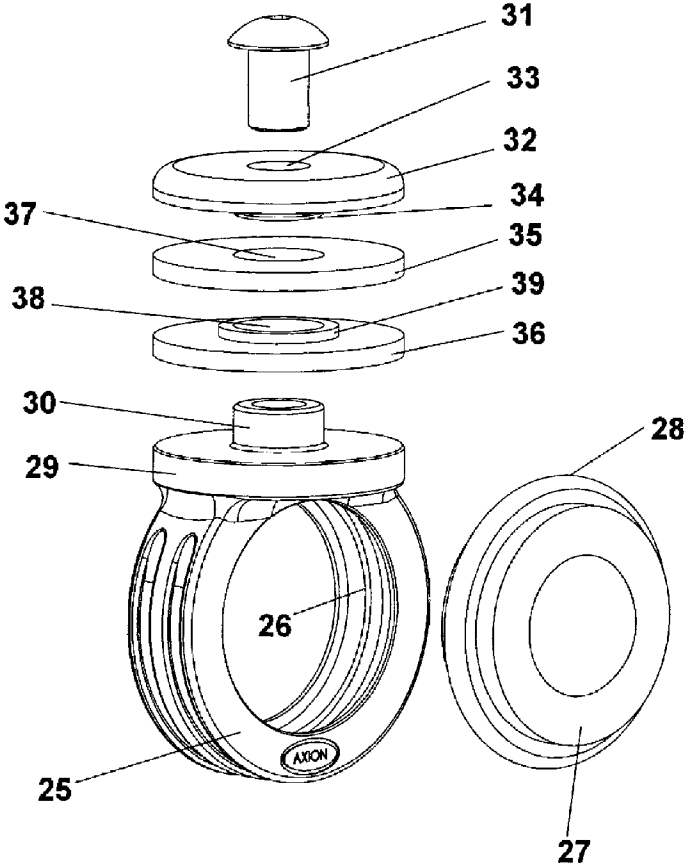
FIG. 6 is an exploded perspective view of the holder shown in FIG. 5.

According to a modification of this invention, an alternative holder is shown in FIGS. 5-7 which includes attachment holder 25 having groove 26 formed on the inner surface thereof. Attachment holder 25 is adapted to receive device 27 which includes ring 28 formed around the peripheral edge thereof.

In order to attach the holder to the archery bow, as shown in FIG. 7, base 29 is secured to attachment holder 25 with apertured threaded coupler 30 upstanding therefrom for the purpose of receiving screw 31. To complete the basic elements of the holder shown in FIGS. 5-7, cover 32 includes aperture 33 formed therein and apertured sleeve 34 is disposed on the underside thereof. Flexible attachment rings 35 and 36 include apertures 37 and 38 formed therein, respectively, with apertured spacer ring 39 integrally joined to the upper surface of attachment ring 36. A corresponding apertured spacer ring is integrally joined to the underside of attachment ring 35 and is not shown in the drawings.

In order to install the holder shown in FIGS. 5 and 6 onto an archery bow, as shown in FIG. 7, device 27 is inserted into attachment ring 25 whereby ring 28 is disposed in groove 26 to secure device 27 in position. Screw 31 is then loosened and attachment holder 25 is positioned below split limbs 2 and 3. Attachment ring 36 is positioned on base 29 and apertured coupler 30 is extended through aperture 38 and then attachment ring 36 is positioned in face contacting relation with the underside of split limbs 2 and 3 with apertured coupler 30 disposed between split limbs 2 and 3.

Following this, attachment ring 35 is positioned on the top surfaces of split limbs 2 and 3 and cover 32 is placed in face contacting relation with the upper surface of attachment ring 35 such that apertured sleeve 34 extends through aperture 37. By this means, spacer ring 39 and the corresponding spacer ring disposed on the underside of attachment ring 35 are disposed in face contacting relation to provide the spacing to receive split limbs 2 and 3. Screw 31 then is inserted through apertures through apertures 33, 37 and 38 and into apertured threaded coupler 30 whereby screw 31 is tightened so that the holder is securely affixed to the archery bow and between split limbs 2 and 3.

Therefore, by this invention, a wide variety of vibration dampening and balancing devices are interchangeably attached to an archery bow quickly and conveniently without the necessity of removing and replacing the entire device.

The invention claimed is:

1. An archery bow vibration dampening and balancing device holder comprising an archery bow having a riser, a pair of flexible limbs extending outwardly from opposite ends of said riser, at least one of said flexible limbs comprising it pair of spaced split limbs extending outwardly from the free end of said flexible limb, a holder for an archery bow vibration dampening and balancing device, said holder comprising a base, a portion of said holder disposed between said split limbs, said base comprising a cavity, and a pair of spaced flanges extending into said cavity.

2. A holder according to claim 1 wherein said base comprises spaced indented sides.

3. A holder according to claim 2 wherein said split limbs are disposed respectively in face contacting relation with said indented sides.

4. A holder according to claim 2 wherein at least one protrusion extends outwardly from each of said indented sides.

5. A holder according to claim 1 wherein an attachment holder comprises a coupling attached to the outer surface thereof, a neck extending from said coupling, and an attachment bar secured to said neck remote from said coupling.

6. A holder according to claim 5 wherein said attachment bar comprises a pair of shoulders extending outwardly therefrom and wherein said shoulders are disposed in overlapping relation respectively with said flanges.

7. A holder according to claim 1 wherein said holder comprises an attachment holder and wherein a base is secured to the outer edge of said attachment holder.

8. A holder according to claim 7 wherein an apertured threaded coupler extends upwardly from said base and a screw is interconnectable with said apertured threaded coupler.

9. A holder according to claim 8 wherein a pair of apertured attachment rings are interposed between said screw and said base and a cover overlies the upper one of said attachment rings.

10. A holder according to claim 9 wherein a pair of spacer rings extend respectively from said aperture attachment ring and are secured in face contacting relation.

11. A holder according to claim 9 wherein said split limbs are disposed between said apertured attachment rings.

12. An archery bow vibration dampening and balancing device comprising an archery bow having a riser, a pair of flexible limbs extending outwardly from opposite ends of said riser, at least one of said flexible limbs comprising a pair of spaced split limbs extending outwardly from the free end of said flexible limb, a holder for an archery bow vibration dampening and balancing device, a portion of said holder disposed between said split limbs, said holder comprising an attachment holder, a base secured to the outer edge of said attachment holder, an apertured threaded coupler extending upwardly from said base, a screw interconnectable with said apertured threaded coupler, a pair of apertured attachment rings interposed between said screw and said base, a cover overlying the upper one of said attachment rings, and a pair of spacer rings extending respectively from said aperture attachment rings toward each other and being disposed in face contacting relation to provide a space for disposition of said split limbs therebetween.

* * * * *